US007153108B2

(12) United States Patent
Puff et al.

(10) Patent No.: US 7,153,108 B2
(45) Date of Patent: Dec. 26, 2006

(54) LINEAR COMPRESSOR

(75) Inventors: Rinaldo Puff, Joinville (BR); Dietmar Erich Bernard Lilie, Joinville (BR)

(73) Assignee: Empresa Brasileira de Compressores S.A. - Embraco, Joinville (BR)

( * ) Notice: Subject to any disclaimer, the term of this patent is extended or adjusted under 35 U.S.C. 154(b) by 168 days.

(21) Appl. No.: 10/477,372

(22) PCT Filed: May 7, 2002

(86) PCT No.: PCT/BR02/00066

§ 371 (c)(1),
(2), (4) Date: Nov. 6, 2003

(87) PCT Pub. No.: WO02/090773

PCT Pub. Date: Nov. 14, 2002

(65) Prior Publication Data

US 2004/0141860 A1 Jul. 22, 2004

(30) Foreign Application Priority Data

May 8, 2001 (BR) ..... 0102698

(51) Int. Cl.
*F04B 35/04* (2006.01)

(52) U.S. Cl. ..... 417/417

(58) Field of Classification Search ..... 417/417
See application file for complete search history.

(56) References Cited

U.S. PATENT DOCUMENTS 3,490,684 A 1/1970 Rietveld et al.
3,947,155 A 3/1976 Bidol
5,993,175 A * 11/1999 Kim et al. ..... 417/417

FOREIGN PATENT DOCUMENTS

| | | | |
|---|---|---|---|
| DE | 1 403 458 | A1 | 4/1969 |
| EP | 0 620 367 | A1 | 10/1994 |
| WO | WO-01/29444 | A1 | 4/2001 |

* cited by examiner

*Primary Examiner*—Anthony D. Stashick
*Assistant Examiner*—Samuel E. Belt
(74) *Attorney, Agent, or Firm*—Darby & Darby

(57) ABSTRACT

A linear compressor having a cylinder (2) and a piston (1) that is moved by an electric linear motor (4, 5, 6) is provided with one or more elastic elements (30, 50) made of steel wire having a central volute portion (30*a*, 50*a*). A leg (30*b*, 30*c*, 50*b*, 50*c*) extends from each end of the central volute portion (30*a*, 50*a*). In a first embodiment, one of the legs (30*b*) is fastened internally of the piston (1) and the other leg (30*c*) to a part of the cylinder (2). In a second embodiment, the central volute portion (50*a*) is mounted directly to the piston (1) and the two legs (50*b*, 50*c*) are fixedly connected to the cylinder (2). When the piston is moved by the action of the electric linear motor, the wire of the central volute portion of the elastic element distorts and stretches in the direction of travel of the piston. It is preferred that several elastic elements be mounted to the piston (1) having like portions of the central volute portion angularly spaced apart. Such arrangement provides a more equal distribution of the forces of the piston acting against the central volute portions of the elastic elements.

13 Claims, 5 Drawing Sheets

FIG.5
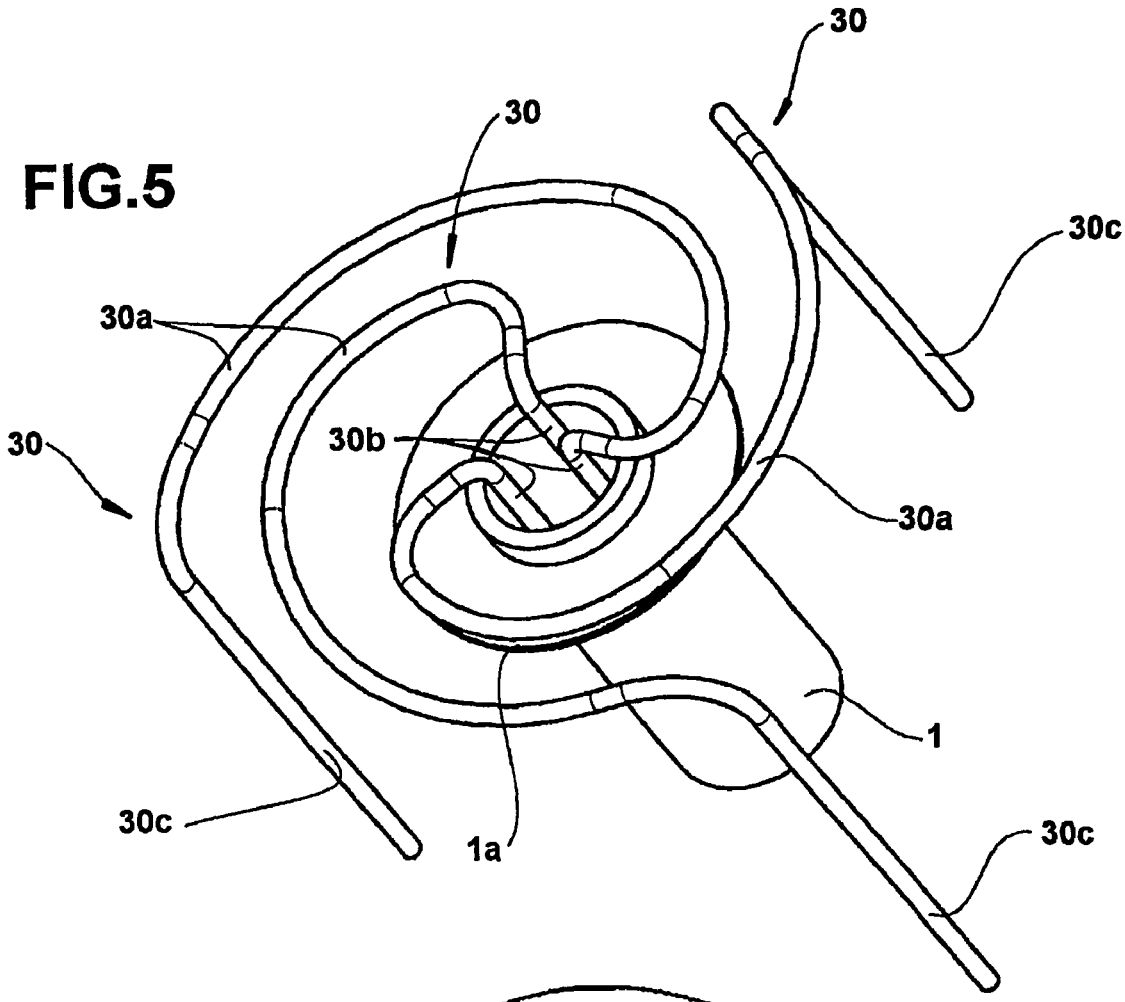
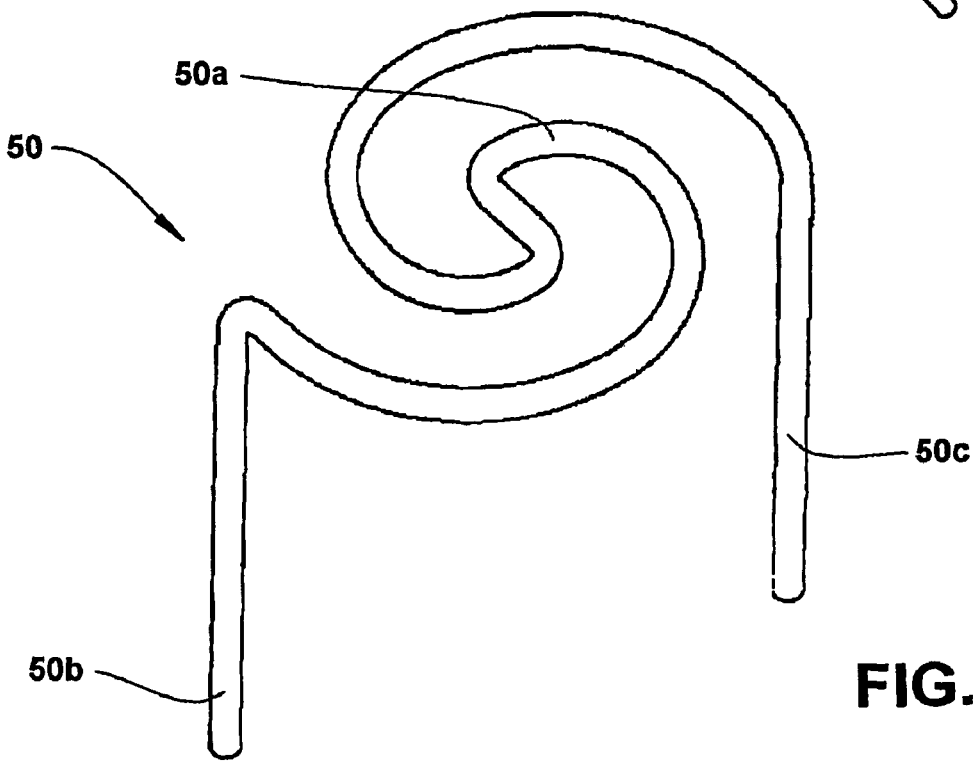
FIG.7

LINEAR COMPRESSOR

This is a U.S. national phase application under 35 U.S.C. §371 of International Patent Application No. PCT/BR2002/00066 filed May 7, 2002 and claims the benefit of Brazilian Application No. PI 0102698–4 filed May 8, 2001. The International Application was published in English on Nov. 14, 2002 as International Publication No. WO/2002/090773 under PCT Article 21(2). Both applications are incorporated herein by reference.

FIELD OF THE INVENTION

The present invention relates to a linear compressor and, more particularly, to an elastic mounting arrangement for a linear compressor.

BACKGROUND OF THE INVENTION

Electric linear motors are well known devices, in which one of a coil or magnet element is mounted to a fixed member, and the other element is mounted to a member to be moved. An electric current is applied to the coil, which generates magnetic lines of force to interact with the magnet to produce linear motion of the movable member. Such electric linear motors have been used in refrigeration compressors in which the movable member is the piston of the compressor and the magnet is mounted to said piston. The coil is fixedly mounted to an external portion of the compressor structure that forms the cylinder.

In a linear compressor of one known type, such as that shown in FIG. 1, the compression of the gas results from the axial movement of a piston 1 inside a cylinder 2 that has an external block 2*a* with an axial tubular wall 2*b*. The cylinder is closed by a cylinder head 3 on which there is a valve plate 3*d* on which are positioned a suction valve 3*a* and a discharge valve 3*b*. The valves regulate the inlet and outlet of the gas compressed in the cylinder. The piston is driven by an electric linear motor formed by a ring shaped actuator 4 that is attached to a base flange 1*a* of the piston. The actuator 4 supports a magnetic member 5, usually formed of permanent magnets. A coil 6 made of wire is fixedly mounted to the inner wall of a sleeve extension 6*a* of the cylinder 2. Electric current is supplied to the coil 6 to produce magnetic lines of force to interact with the permanent magnets and produce the linear reciprocating motion of the actuator 4 and the piston 1, with the magnet 5 moving between the outer wall of the sleeve extension 6*a* of the cylinder and the coil 6.

The piston 1 is mounted by means of a flexible rod 8 against a set of flat springs 7, and the set of flat springs 7 is rigidly mounted to the axial tubular wall 2*b*. The piston 1, actuator 4, magnetic component 5, flexible rod 8, and the set of flat springs 7 form together the resonant assembly of the compressor.

In the embodiment of FIG. 1, the set of flat springs against which the piston acts usually is made from spring steel plate. The flexible rod 8 has the function of reducing the forces resulting from mistakes in manufacturing of the component pieces and mistakes that occur during mounting, in order that such forces are not transmitted in their entirety to the piston, thereby avoiding wearing of the piston against the cylinder. Due to manufacturing asymmetries, the flat springs have a tendency to produce undesirable forces that are transverse to the flexible rod 8 and to the piston 1. Another problem of this construction is that the flat springs 7 are known to be relatively expensive to make, since they require sophisticated and complex cutting and finishing processes. The flexible rod 8 also is a component that is relatively difficult to make, since it has to be produced from special materials.

A second known embodiment of a linear compressor is shown in FIG. 2, in which a system of helical springs 20 substitutes the set of flat springs 7 of the prior art embodiment illustrated in FIG. 1. In this case, there is a first helical spring 20*a* mounted between the piston 1 and the cylinder 2, and a second helical spring 20*b* mounted between the piston and the bottom support wall 21 which is mounted to the axial tubular wall 2*b*. In this second embodiment of the prior art, the resonant assembly of the compressor is formed by the piston 1, actuator 4, magnet 5, and helical springs 20*a*, 20*b*.

The construction of the compressor of FIG. 2 has the disadvantage of requiring a housing with relatively large dimensions to receive the helical springs 20*a*, 20*b*, each of the latter being positioned at each side of the base flange 1*a* of the piston. Further to the problem above, the momentum resulting from the eccentric force produced by the helical springs on the piston is not minimized or avoided, and this may produce wear of the moving component parts of the compressor.

As a function of the prior art problems mentioned above, a need exists for an improvement in the spring mounting system for a compressor of the type considered herein, that eliminates the disadvantages presently found.

OBJECT OF THE INVENTION

It is a generic object of the present invention to provide a linear compressor, which is compact, of low cost and wear resistant, by using novel spring elements made of spring wire, which allow the resonant assembly to move linearly together with the deformation of the spring elements, without the latter producing forces transverse to the linear displacement axis of the piston that are sufficient to provoke premature wear of the movable parts of the compressor.

SUMMARY OF THE INVENTION

In accordance with the invention, a linear compressor is provided with one or more elastic, or resilient, elements with a novel construction. Each such element is made of spring wire having a central volute portion that is in the form of a scroll or a spiral. A leg extends from each end of the central volute portion. In one embodiment, one of the legs is fastened internally of the piston and the other leg is fastened to a part of the cylinder structure. When the piston is moved by the action of the electric linear motor, the central volute portion of the elastic element distorts or stretches in the direction of travel of the piston. It is preferred that several of the elastic elements be mounted to the piston having similar central volute portions that are angularly spaced from each other. This provides a more equal distribution of the forces of the piston acting against the central volute portions of the elastic elements.

In another embodiment of the invention, the central volute portion of an elastic element is mounted directly to the bottom of the piston, and the two legs are fixedly connected to the cylinder structure. As the piston reciprocates, it directly distorts the central volute portion of the elastic element, in order to provide a spring action. Also in this embodiment, it is preferred that a plurality of elastic elements be used to equally distribute the forces.

The wire type elastic elements of the present invention have the advantages of being easy to make, being inexpensive and providing for a compact compressor structure. Also, the piston is moved in a manner against the elastic elements, so that wear between the piston and the cylinder is reduced.

BRIEF DESCRIPTION OF THE DRAWINGS

The invention will be described below with reference being made to the annexed drawings, in which:

FIG. 5 is a perspective view of an assembly of elastic elements used in the linear compressor of FIG. 3;

FIG. 7 is a perspective view of an elastic element used in the embodiment of FIG. 6.

DETAILED DESCRIPTION OF THE INVENTION

Figure 1:
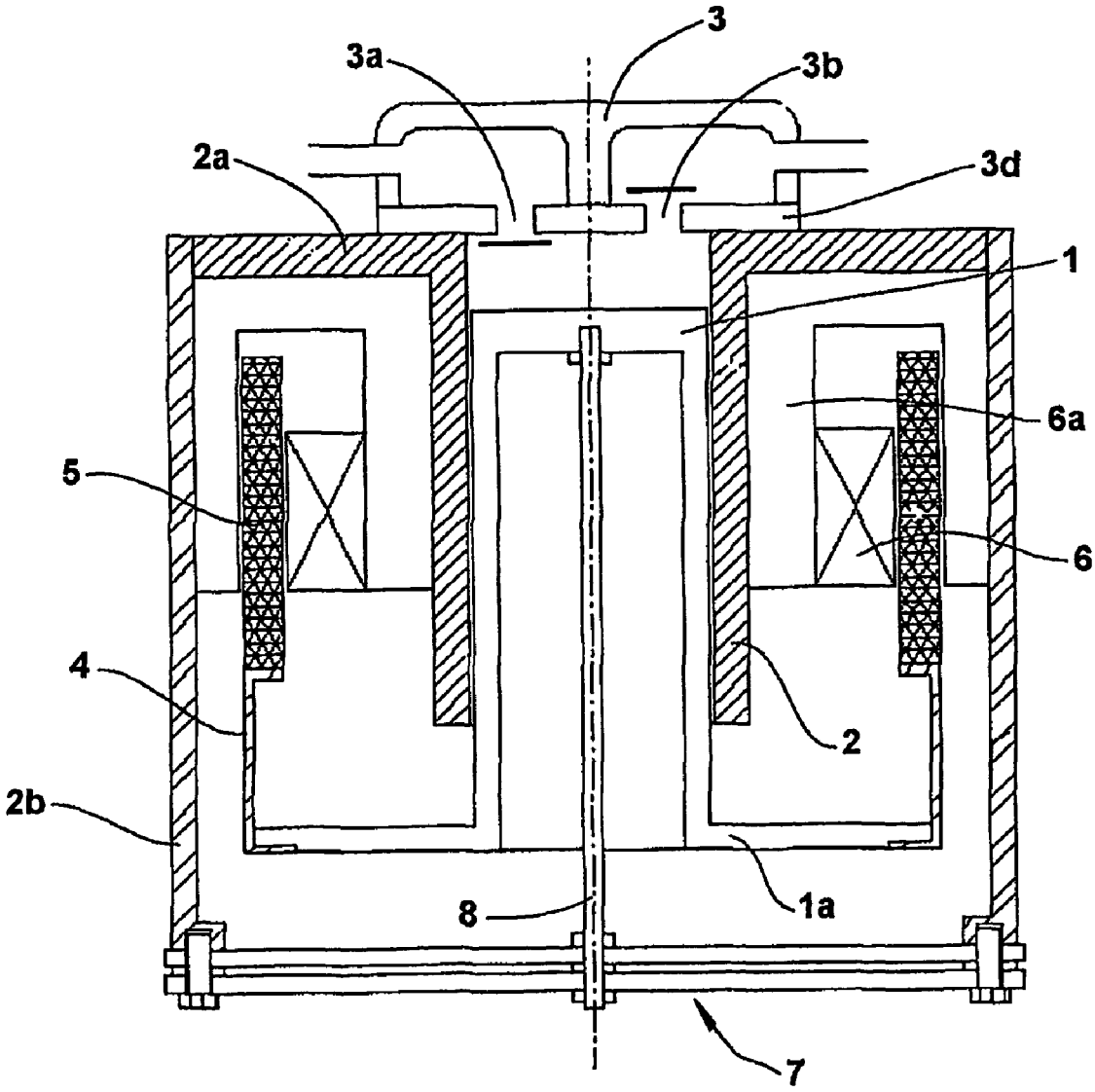
FIG.1 PRIOR ART
FIG. 1 is a longitudinal cross-sectional view of one prior art linear compressor.
Figure 2:
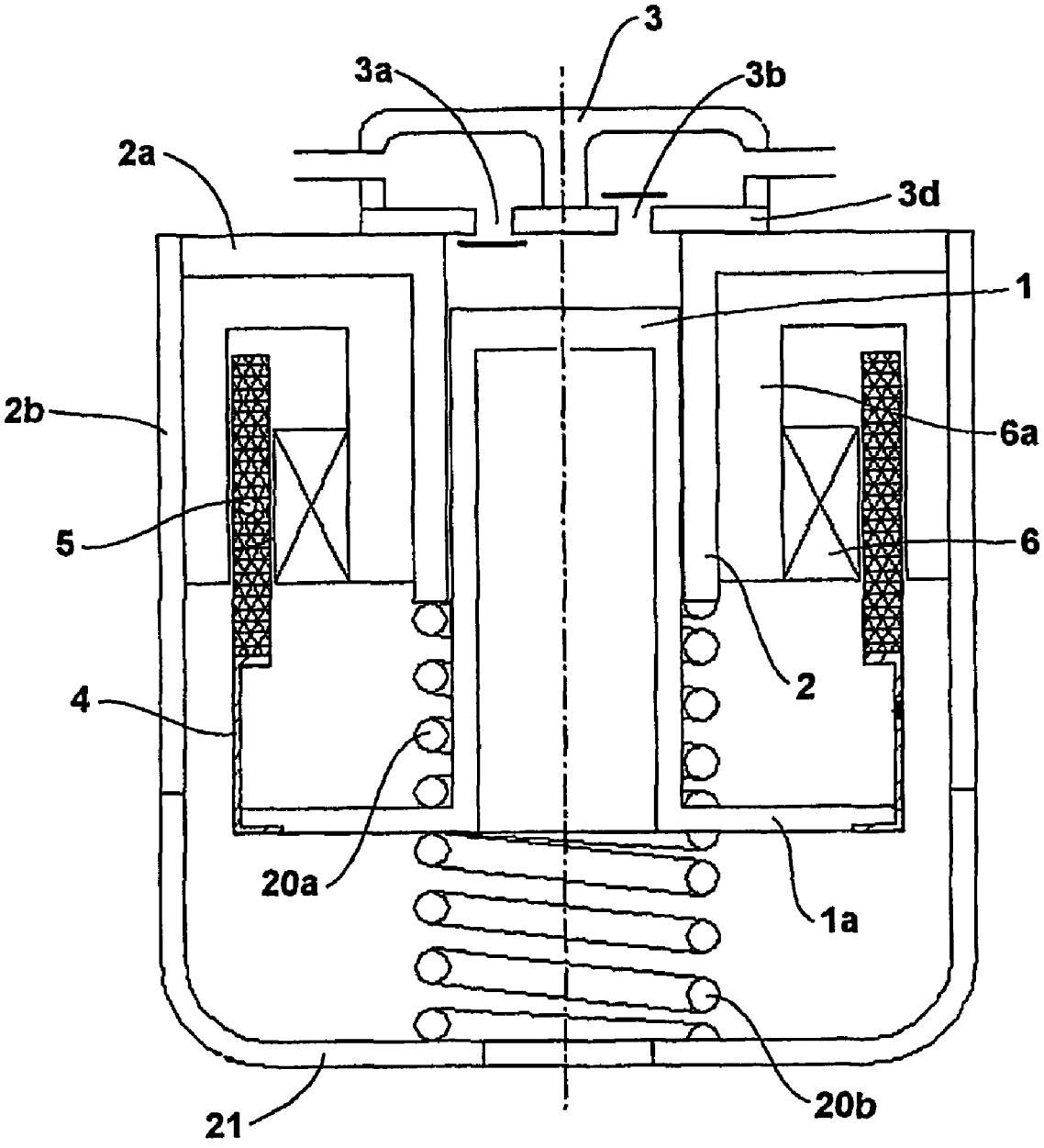
FIG.2 PRIOR ART
FIG. 2 is a longitudinal cross-sectional view of another type of prior art linear compressor.
Figure 3:
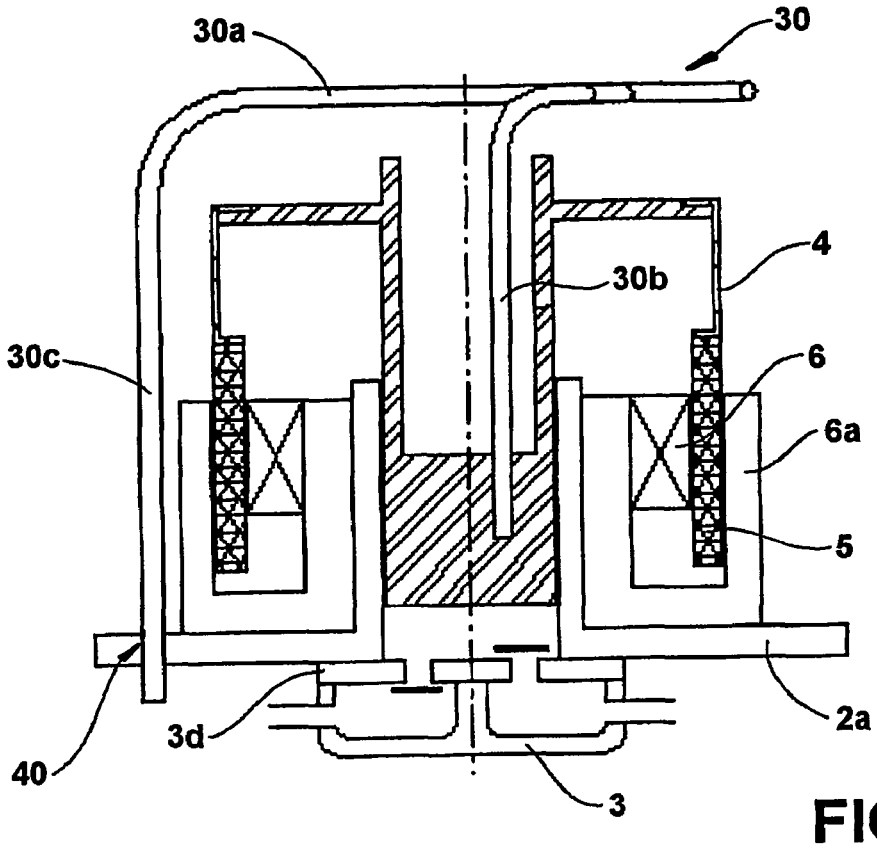
FIG. 3 is a longitudinal cross-sectional view of a part of a linear compressor made in accordance with a first embodiment of the present invention.

A first embodiment of the invention is shown in FIG. 3, in which similar elements shown in FIGS. 1 and 2 have the same reference numerals. In this first embodiment, an assembly of wire type elastic elements 30 are used instead of the set of flat springs 7 or the set of the helical springs 20 of the prior art illustrated in said FIGS. 1 and 2. The elastic elements 30 are made of spring steel wire having any desired cross section as needed for a particular application and the wire cross-section does not necessarily have to be cylindrical.

Figure 4:
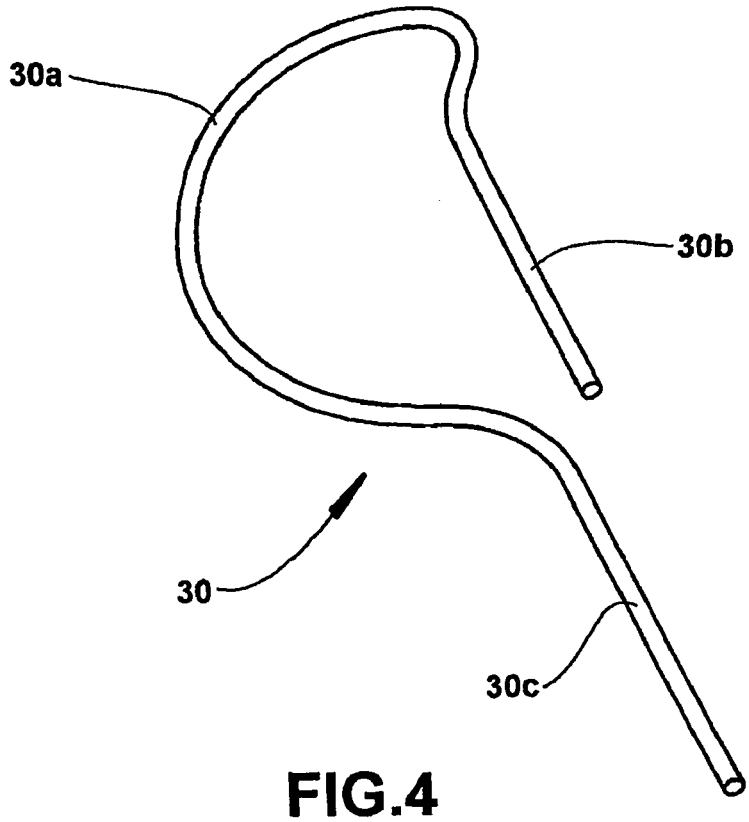
FIG. 4 is a perspective view of one of the elastic elements used in the linear compressor of FIG. 3.

FIG. 4 shows one of the elastic elements 30 in a perspective view to facilitate its understanding. As shown in FIG. 4, the elastic element 30 has a central volute portion 30*a* that is substantially flat. The central volute portion 30*a* has a shape, which may be a part of a scroll, spiral or complex curve, or in any other shape. The shape of the central volute portion 30*a* gives the element the necessary resilience and stiffness in the direction of piston displacement. The elastic element 30 also has an internal leg 30*b* extending in a direction at about 90° from the central volute portion 30*a*. The internal leg 30*b* is affixed internally in the piston 1 by any suitable means, such as welding, glue or interference fit, or any other mechanical means. The internal leg 30*b* also could be affixed to the bottom of the piston, but this would make the structure larger, since the internal leg 30*b* has to be fairly long in order to provide sufficient distortion of the central volute portion 30*a*, minimizing central efforts on the piston. Extending from the other end of the central volute portion 30*a* and also at an angle of about 90° is an external leg 30*c*, which may be straight. The internal leg 30*b* and the external leg 30*c* are spaced angularly from each other at about 90° around the central volute portion 30*a*. The end of the external leg 30*c* is affixed to a part 40 of the cylinder structure by any fixing means, such as weld, glue, screw, interference fit, etc.

FIG. 5 shows an assembly of three elastic elements 30 to be mounted to the compressor and forming part of the resonant assembly. The assembly of the elastic elements should be formed with at least two elastic elements. The elastic elements 30 are angularly spaced relative to each other. For example, if there are provided three elastic elements, then the internal legs 30*b* and the external legs 30*c* will be spaced apart by about 120°.

In the operation of the structure of FIGS. 3, 4, and 5, as the piston 1 is reciprocated by the action of the electric linear motor, the internal legs 30*b* of the elastic elements move the wires of the central volute portions 30*a* in the same direction as the piston movement. That is, the wires of the central volute portions 30*a* stretch from one side to the other from the original shape in which the central volute portions are flat. The internal and external legs 30*b* and 30*c* are provided to have, as a first objective, to reduce or eliminate the forces resulting from possible manufacturing and mounting errors of the flat or helical springs that are used in the prior art structures. The second objective of the internal and external legs of the present assemble is to provide to said springs a structure that operates with a minimum of twisting forces.

The embodiment of the invention shown in FIGS. 3, 4, and 5 has a number of advantages over prior constructions, such as those illustrated in FIGS. 1 and 2. First, the linear compressor can be made more compact, since the long helical springs (FIG. 2) and flexible rod (FIG. 1) for the piston are not needed anymore. Second, the elastic elements are of low cost, easy to manufacture and highly reliable. For example, the elastic element is made of spring steel wire that is bent to its desired shape over a die, with or without heating, depending on the desired characteristics. Third, the elastic elements 30 minimize the eccentric or transverse forces applied to the piston. By using two or more of the elastic elements having their external legs 30*c* spaced angularly apart, a multi-directional distribution of the forces related to the moving piston can be achieved. Fourth, the present construction provides greater wear resistance for the piston and cylinder of the compressor.

Figure 6:
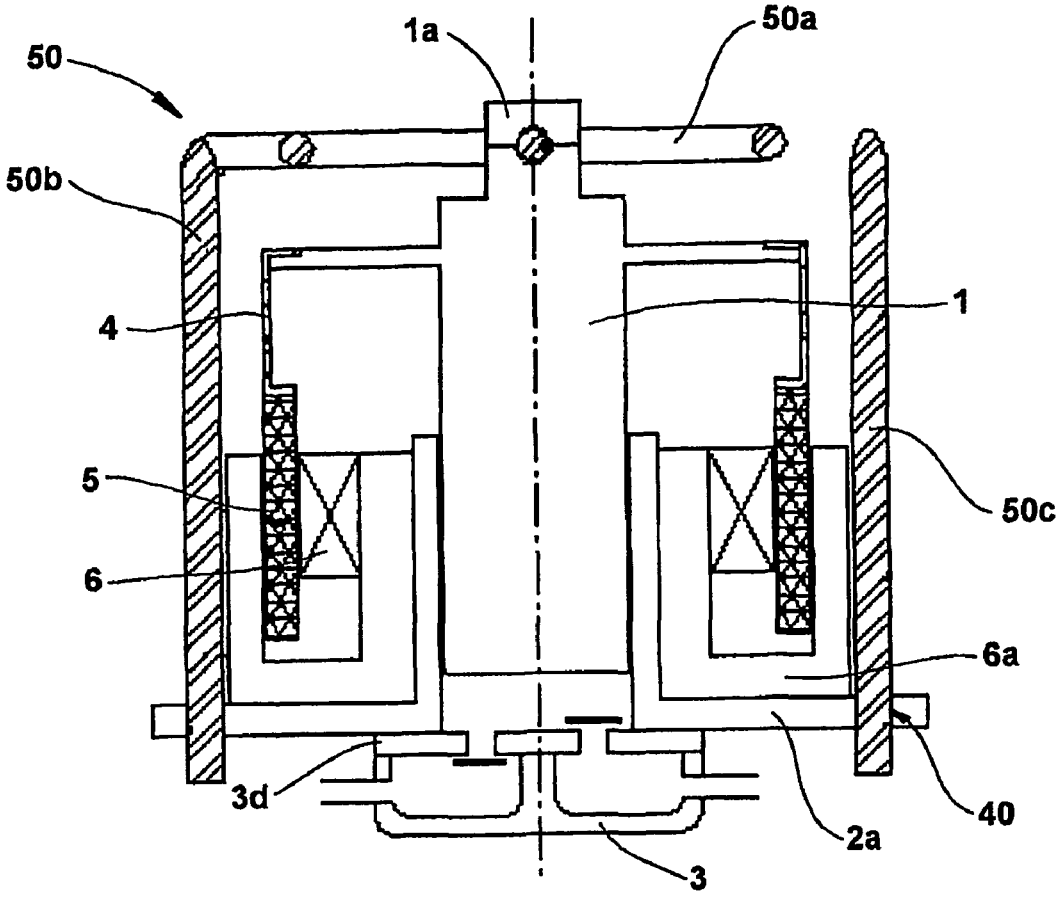
FIG. 6 is a longitudinal cross-sectional view of a linear compressor constructed in accordance with another embodiment of the invention.
Figure 8:
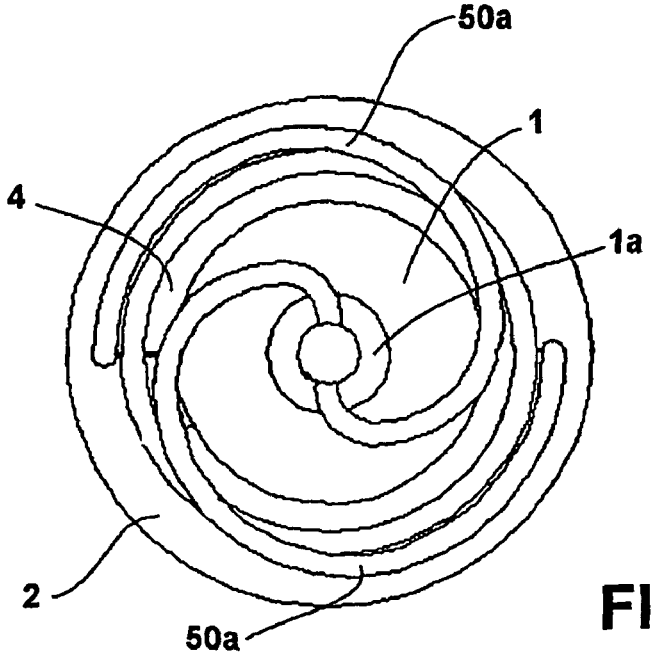
FIG. 8 is an end view of an assembly of the elastic elements constructed according to the embodiment illustrated in FIG. 6.

FIGS. 6, 7 and 8 show a second embodiment of the invention in which the same reference numbers are used for the same components, such as in relation to the description of the first embodiment illustrated in FIGS. 3–5. In this second embodiment, the piston 1 has a rigid stem 1*a*. The elastic element 50 has the central volute portion 50*a* also flat shaped, having two curves extending in opposite directions. There is provided a leg 50*b*, 50*c*, extending from each end of the central volute portion 50*a* and extended so as to form an angle of about 90° in relation to said central volute portion 50*a*. The legs 50*b* are angularly spaced apart at about 180°, although a smaller angle can be used. The central volute portion 50*a* is mounted to the rigid stem 1*a* of the piston 1 and the legs 50*b*, 50*c* extend in a direction along the length of the piston and their ends are mounted to the portion 40 of the cylinder.

FIG. 7 shows an assembly of two elastic elements 50 mounted angularly spaced apart by about 180°. The legs 50*b*, 50*c* are consequently equally spaced apart around the cylinder. As in the embodiments of FIGS. 3, 4, and 5, the central volute portion 50*a* of an elastic element 50 distorts from one side to the other and provides an elastic characteristic as the piston 1 moves. This embodiment has an advantage in that it does not have legs 30*b* internal of the piston. Another advantage of this construction is the possibility of employing only one elastic element.

Specific features of the invention are shown in one or more of the drawings for convenience only, as each feature may be combined with other features in accordance with the invention. Alternative embodiments will be recognized by those skilled in the art and are intended to be included within the scope of the appended claims. Accordingly, the above description should be construed as illustrating and not limiting the scope of the present invention.

The invention claimed is:

1. A linear compressor comprising:

a piston that is reciprocated within a cylinder by the action of an electric linear motor including an elastic element for absorbing forces of the piston, wherein said elastic element is formed by a wire having a central volute portion and a leg extending from each end of the central volute portion, at least one of said legs being extended along the length of the piston, with the elastic element being mounted by said legs between the piston and a part of the cylinder, such that the central volute portion is distorted to have a spring action as the piston is moved.

2. A linear compressor, as set forth in claim 1, wherein one leg of the elastic element is mounted to a part of the cylinder.

3. A linear compressor, as set forth in claim 2, wherein said one leg is mounted internal of said piston.

4. A linear compressor, as set forth in claim 3, wherein said legs of said elastic element are generally transverse to said central volute portion and spaced apart by an angle of about 90°.

5. A linear compressor, as set forth in claim 1, wherein there is provided a plurality of elastic elements whose central volute portions and legs are angularly spaced from each other.

6. A linear compressor, as set forth in claim 1, wherein the central volute portion of the elastic element is mounted to the piston and said legs are mounted to the cylinder.

7. A linear compressor, as set forth in claim 6, wherein said legs of said elastic element are generally transverse to said central volute portion and angularly spaced apart by about 180°.

8. A linear compressor, as set forth in claim 1, wherein said central volute portion is substantially flat when not subjected to forces of the moving piston.

9. A linear compressor, as set forth in claim 2, wherein there is provided a plurality of elastic elements whose central volute portions and legs are angularly spaced from each other.

10. A linear compressor, as set forth in claim 3, wherein there is provided a plurality of elastic elements whose central volute portions and legs are angularly spaced from each other.

11. A linear compressor, as set forth in claim 4, wherein there is provided a plurality of elastic elements whose central volute portions and legs are angularly spaced from each other.

12. A linear compressor comprising:

a piston that is reciprocated within a cylinder by the action of an electric linear motor including an elastic element for absorbing forces of the piston, wherein said elastic element is formed by a wire having a central volute portion and a leg extending from each end of the central volute portion with the elastic element being mounted by said legs between the piston and a part of the cylinder, such that the central volute portion is distorted to have a spring action as the piston is moved, and wherein a plurality of elastic elements are provided, each having its central volute portion mounted to the piston and said legs mounted to the cylinder, and said central volute portions and the legs thereof being angularly spaced from each other.

13. A linear compressor having a piston that is reciprocated within a cylinder by the action of an electric linear motor including an elastic element for absorbing forces of the piston, wherein said elastic element is formed by a wire having a central volute portion and a leg extending from each end of the central volute portion with the elastic element being mounted by said legs between the piston and a part of the cylinder, such that the central volute portion is distorted to have a spring action as the piston is moved, and wherein there is provided a plurality of elastic elements, each having its central volute portion mounted to the piston and said legs mounted to the cylinder and generally transverse to said central volute portion, and said central volute portions and the legs thereof being angularly spaced from each other.

* * * * *